US006141946A

United States Patent [19]

Chin-Chang et al.

[11] Patent Number: 6,141,946

[45] Date of Patent: Nov. 7, 2000

[54] LOCATING STRUCTURE OF LASHING TAPE REEL OF BINDING MACHINE

[75] Inventors: Liu Chin-Chang; Su Chi-Chan, both of Taichung, Taiwan

[73] Assignees: Tekpak Corporation, Taichung; Transpak Equipment Corporation, Taipei, both of Taiwan

[21] Appl. No.: 09/320,600

[22] Filed: May 26, 1999

[51] Int. Cl.[7] ..... B65B 13/04

[52] U.S. Cl. ..... 53/589; 100/26

[58] Field of Search ..... 53/589, 389.2; 100/25, 26

[56] References Cited

U.S. PATENT DOCUMENTS

| | | | |
|---|---|---|---|
| 3,853,051 | 12/1974 | Tyler | 53/589 |
| 3,949,662 | 4/1976 | Woomer | 100/26 |
| 3,955,491 | 5/1976 | McMahon | 53/589 |
| 4,938,009 | 7/1990 | Takami | 53/589 |
| 5,079,899 | 1/1992 | Kurachi | 53/589 |
| 5,379,576 | 1/1995 | Koyama | 53/589 |

*Primary Examiner*—Linda Johnson
*Attorney, Agent, or Firm*—Harrison & Egbert

[57] ABSTRACT

A locating structure of a lashing tape reel of a binding machine includes a guide rail member which is formed of a guide seat and two parallel rods, an action disk provided with an electromagnetic clutch which is connected with the guide seat, and a locating disk connected with the action disk by a shaft. The locating structure enables the lashing tape reel of the binding machine to be loaded or unloaded with ease and speed.

1 Claim, 6 Drawing Sheets

LOCATING STRUCTURE OF LASHING TAPE REEL OF BINDING MACHINE

FIELD OF THE INVENTION

The present invention relates generally to a binding machine, and more particularly to a structure for locating a lashing tape reel of the binding machine.

BACKGROUND OF THE INVENTION

As shown in FIGS. 1 and 2, a binding machine 10 of the prior art is provided respectively in the inner wall of the housing thereof with a locating slot seat 11. The binding machine 10 comprises a lashing tape reel 12 which is formed of a primary frame 13 and a secondary frame 15. The primary frame 13 is provided at the center thereof with a threaded rod 14 fastened therewith. The secondary frame 15 is provided at the center thereof with a through hole for receiving the threaded rod 14 which is engaged with a nut 16. The lashing tape is wound on a spool located between the primary frame 13 and the secondary frame 15. The reel 12 is located by the two locating slot seats 11 such that both ends of the threaded rod 14 of the reel 12 must be aligned with the two retaining slots 111 of the two locating slot seats 11.

Such a lashing tape reel 12 of the prior art binding machine 10 as described above is defective in design in that the lashing tape reel 12 can not be loaded or unloaded with ease and speed.

SUMMARY OF THE INVENTION

The primary objective of the present invention is therefore to provide a binding machine with a locating structure which enables the lashing tape reel of the binding machine to be loaded or unloaded with ease and speed.

The objective, features, functions, and advantages of the present invention will be readily understood upon a thoughtful deliberation of the following detailed description of a preferred embodiment of the present invention with reference to the accompanying drawings.

DETAILED DESCRIPTION OF THE EMBODIMENT

Figure 1:
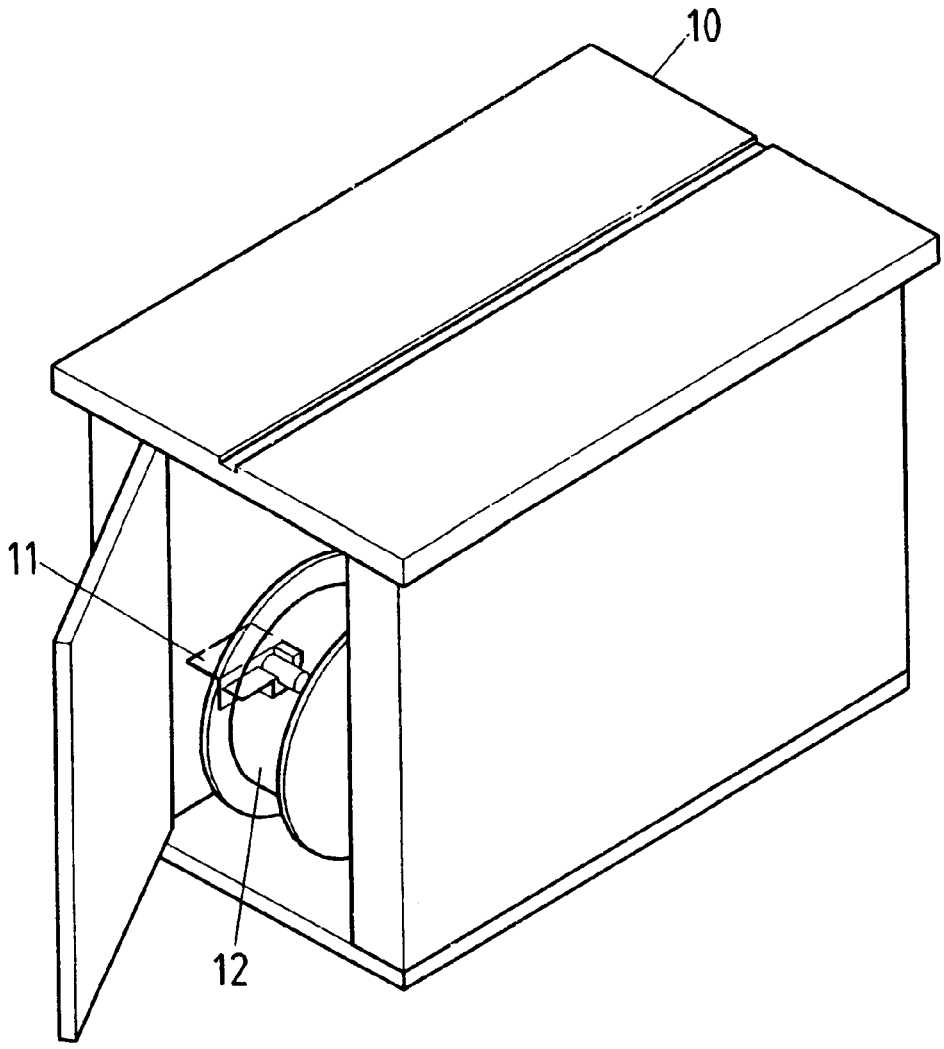
FIG.1 (PRIOR ART)
FIG. 1 shows a perspective view of a binding machine of the prior art.
Figure 2:
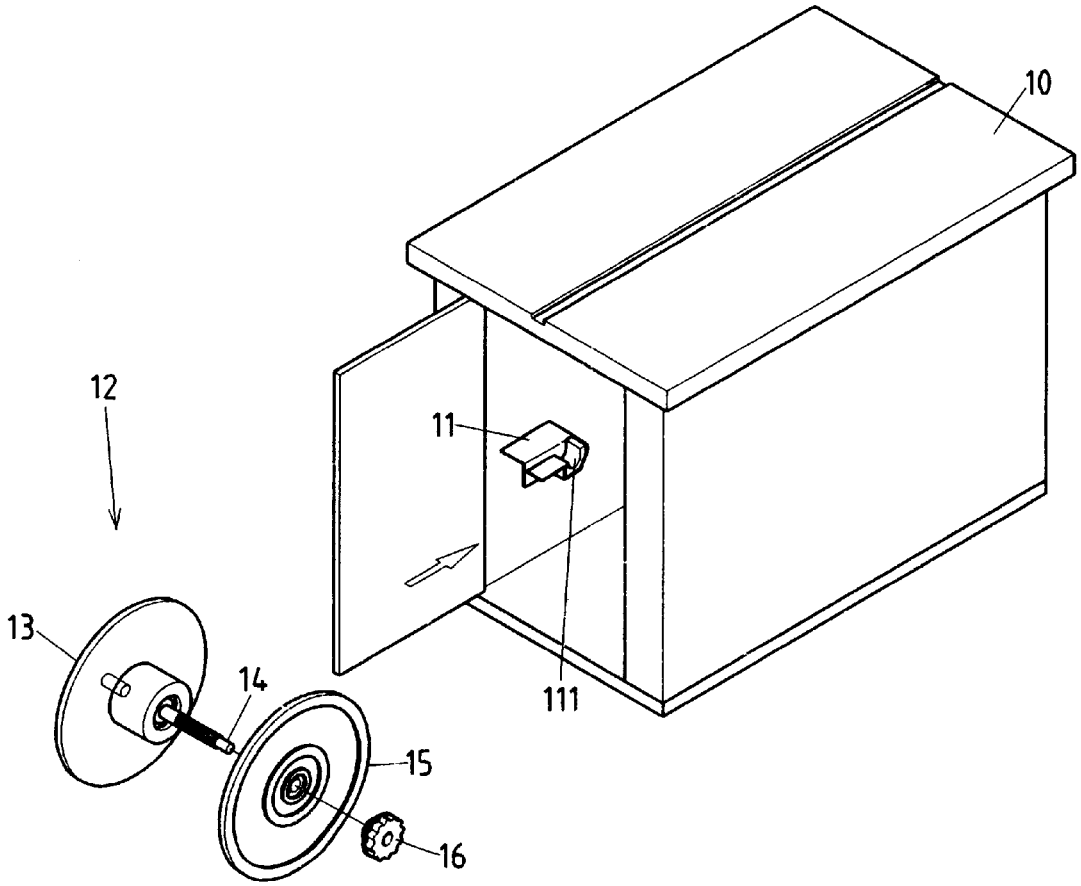
FIG.2 (PRIOR ART)
FIG. 2 shows an exploded view of the binding machine of the prior art.
Figure 3:
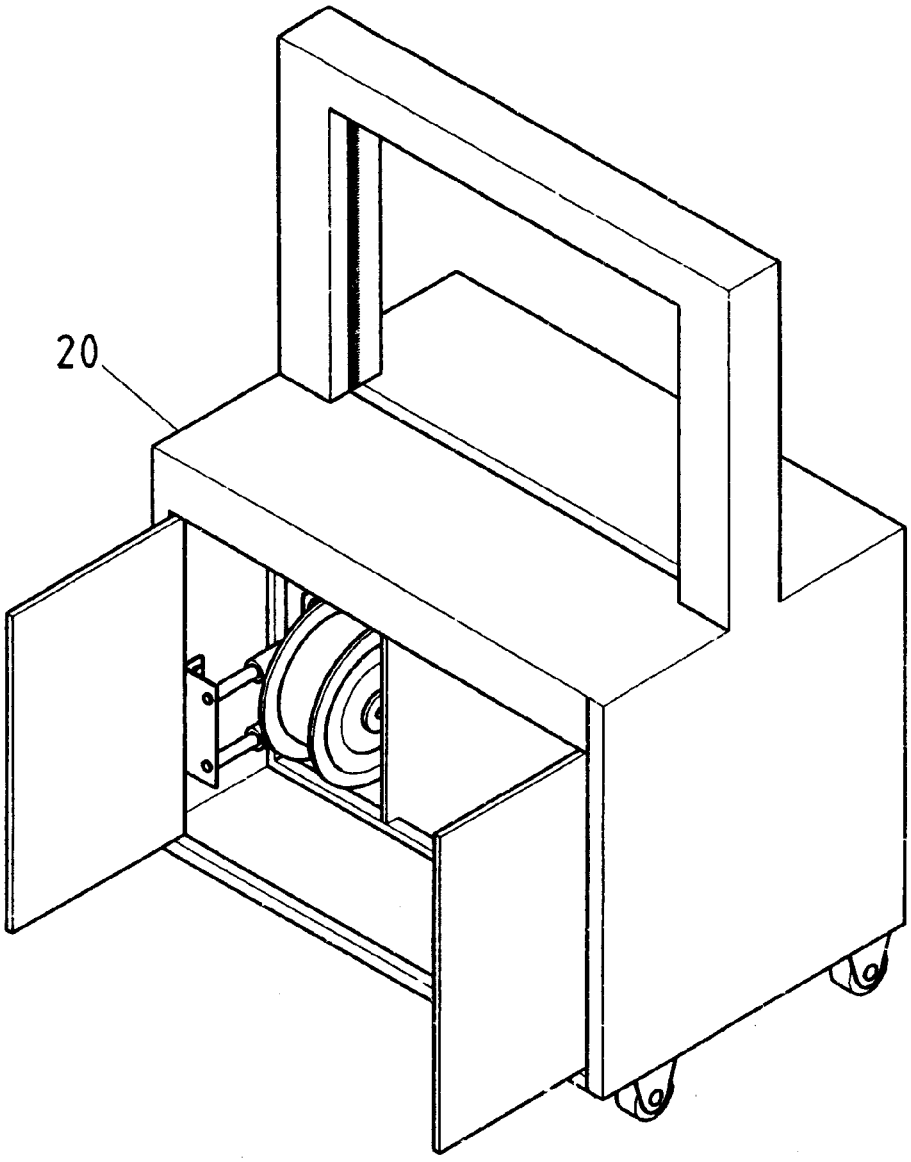
FIG. 3 shows a perspective view of the preferred embodiment of the present invention.
Figure 4:
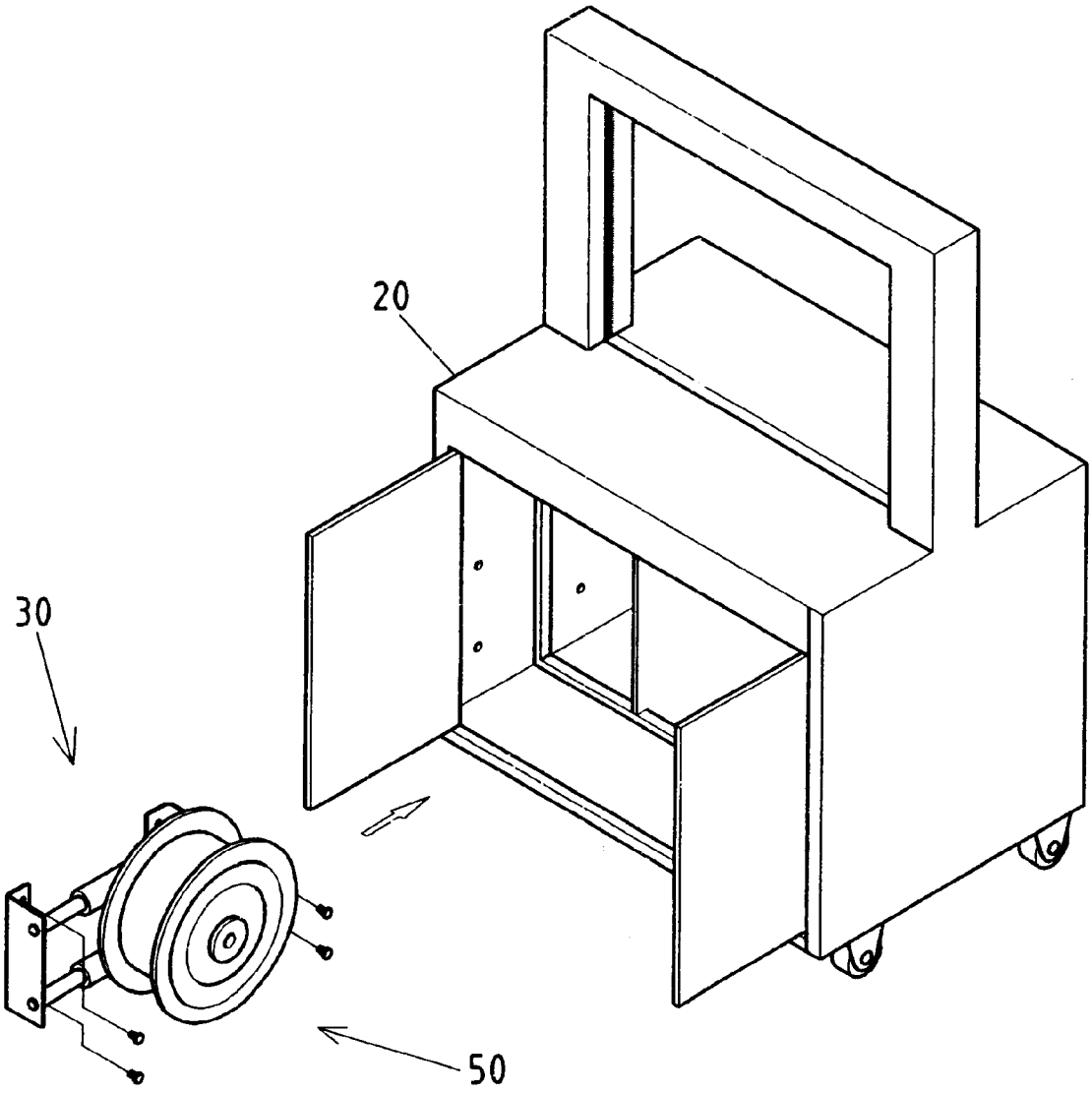
FIG. 4 shows an exploded view of the preferred embodiment of the present invention.
Figure 5:
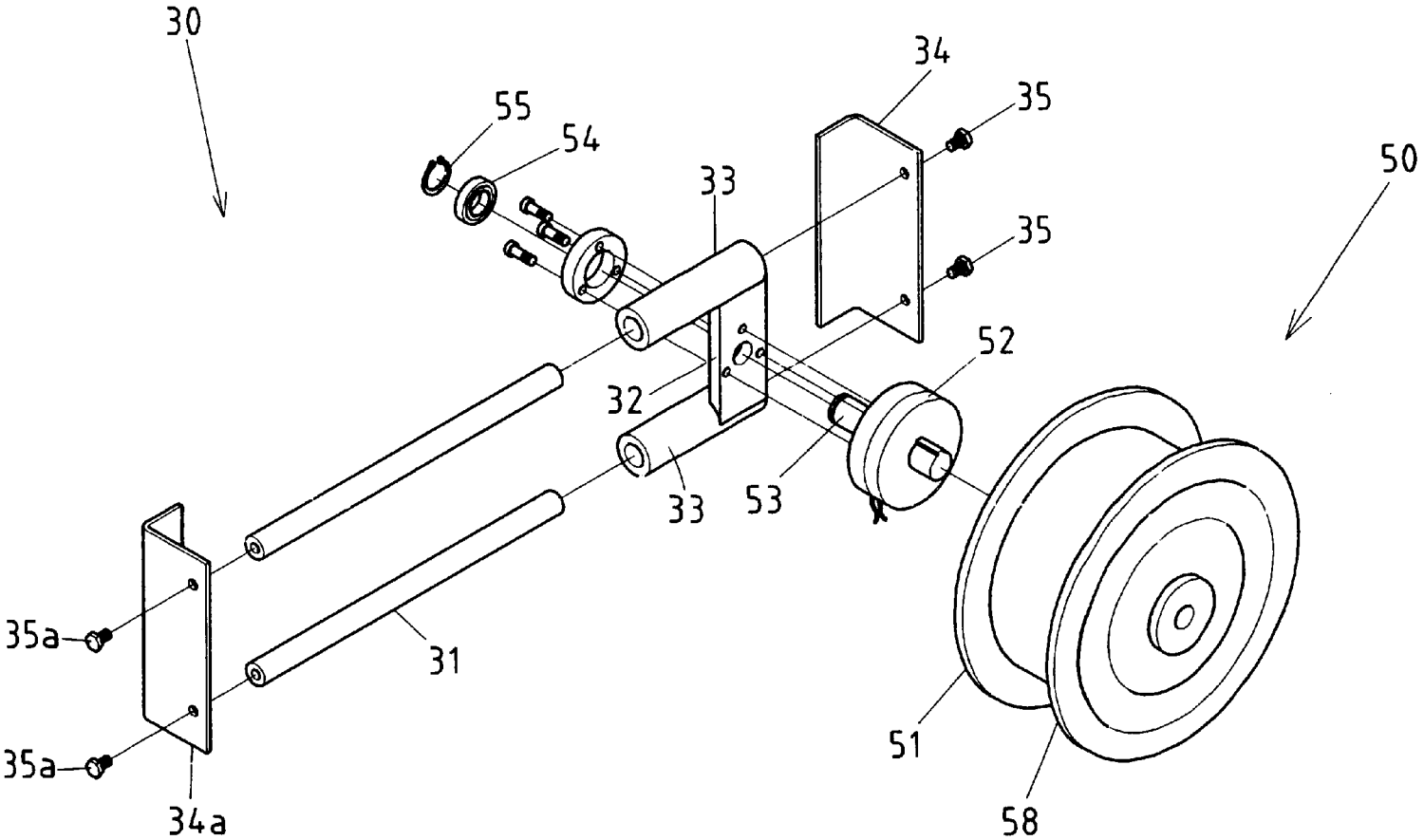
FIG. 5 shows an exploded view of a guide frame and a lashing tape reel of the preferred embodiment of the present invention.

As shown in FIGS. 3, 4, and 5, a binding machine 20 is provided with a structure of the present invention for locating a lashing tape reel 50 of the binding machine 20. The locating structure of the present invention is disposed in the side walls of the housing of the binding machine 20. The lashing tape reel 50 is connected with a guide frame 30.

The guide frame 30 has a guide rail member which is formed of two rods 31 parallel to each other. The two rods 31 are jointly fitted into parallel sleeves 33 on guide seat 32 such that the ends of the two rods 31 are respectively fastened to a fastening piece 34 by a bolt 35. The opposite ends of the two rods 31 are respectively fastened to fastening piece 34*a* by bolts 35*a*. The guide rail member is fastened with the inner side wall of the housing of the binding machine 20 by the two fastening pieces 34 such that a guide seat 32 is slidable on the two rods 31.

The lashing tape reel 50 comprises an action disk 51 and a locating disk 58. The action disk 51 is provided in one side thereof with an electromagnetic clutch 52 which is mounted on a shaft 53. The shaft 53 is connected with the guide seat 32 by a C-shaped retainer 55 in conjunction with a bearing 54. The locating disk 58 is fastened with other side of the action disk 51.

Figure 6:
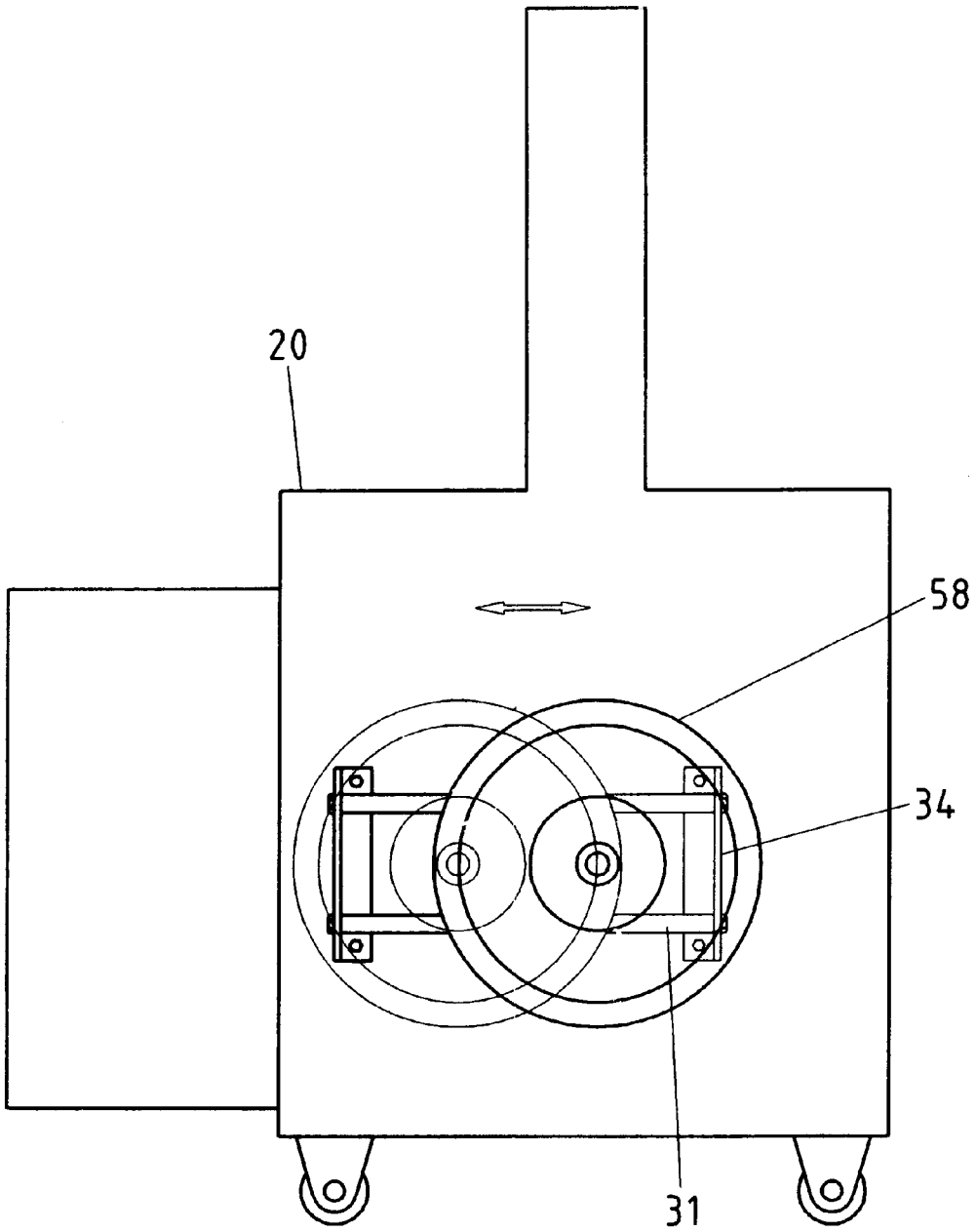
FIG. 6 shows a schematic plan view of the lashing tape reel of the present invention in operation.

As shown in FIGS. 3, 5, and 6, the lashing tape reel 50 of the present invention can be easily unloaded by pulling the reel 50 out such that the reel 50 slides outwards on the rods 31 by means of the guide seat 32. The locating disk 58 can be thus removed for replenishing a new lashing tape, which is disposed between the action disk 51 and the locating disk 58. The loaded reel 50 is then pushed back into the interior of the housing of the binding machine 20.

The lashing tape reel 50 of the present invention can be easily pulled out and pushed back in by means of the guide seat 32 slidable on the two parallel rods 31.

The lashing tape reel 50 can be easily actuated to turn by the action disk 51 which is in turn actuated by the electromagnetic clutch 52. As a result, the reel 50 can be easily loaded with a fresh roll of lashing tape.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

We claim:

1. An apparatus comprising:

a binding machine housing having an inner wall and having an opening at one side thereof;

a guide rail member formed of two rods parallel to each other;

a guide seat having a pair of sleeves slidably receiving respectively said two rods of said guide rail member;

a first fastening piece affixed by a bolt to an end of each of said two rods, said first fastening piece affixed to said inner wall of said housing;

a second fastening piece affixed by a bolt to an opposite end of each of said two rods, said second fastening piece affixed to said inner wall of said housing; and a lashing tape reel comprising an action disk connected to a locating disk, said action disk having an electromagnetic clutch at one side thereof opposite said action disk, said action disk connected by a shaft to said guide seat, said shaft connected within a bearing on one side of said guide seat, said shaft having a C-shaped retainer secured at one end thereof opposite said action disk, said guide seat slidable along said two rods so as to move said lashing tape reel from a position stowed in said housing to a position adjacent said opening.

* * * * *